US006422653B1

(12) United States Patent
Szczepanski et al.

(10) Patent No.: US 6,422,653 B1
(45) Date of Patent: Jul. 23, 2002

(54) FOOT REST LIFTING AND LOWERING DEVICE FOR A WHEELCHAIR

(76) Inventors: Pawel Szczepanski; Maria Szczepanski, both of 171 Avondale Blvd, Brampton, Ontario (CA), L6T 1J1

( * ) Notice: Subject to any disclaimer, the term of this patent is extended or adjusted under 35 U.S.C. 154(b) by 0 days.

(21) Appl. No.: 09/844,332

(22) Filed: Apr. 27, 2001

(51) Int. Cl.[7] ..... A47C 7/50

(52) U.S. Cl. ..... 297/423.29; 297/423.26; 297/DIG. 4; 280/304.1; 280/291

(58) Field of Search ..... 297/423.26, 423.25, 297/423.35, 423.29, DIG. 4; 280/304.1, 250.1, 291

(56) References Cited

U.S. PATENT DOCUMENTS 2,793,682 A 5/1957 Duke
3,790,212 A * 2/1974 Suyetani
4,012,074 A 3/1977 O'Reilly et al.
4,033,624 A 7/1977 Jun
4,463,985 A * 8/1984 Kynast
4,988,114 A 1/1991 Thorton, Jr. et al.
5,358,266 A 10/1994 Roth et al.
5,393,082 A * 2/1995 Fenley
D395,263 S 6/1998 Ponce
5,779,316 A * 7/1998 Sugawa et al.

* cited by examiner

*Primary Examiner*—Laurie K. Cranmer

(57) ABSTRACT

A foot rest lifting and lowering device for a wheelchair. The device includes a footrest coupled to a wheelchair. The footrest includes a bar attached to the wheelchair, a horizontally orientated rod rotatable coupled to a bottom end of the bar, and a plate integrally coupled to the bar and is positionable between a horizontal position and a vertical position. The device includes a shaft rotatably mounted to the wheelchair. A first and second flexible elongated member each have a first end and a second end. The first end of the first elongated member is coupled to a top surface of the plate. The first end of the second elongated member is attached to a bottom surface of the plate. The second ends of the elongated members are attached to the shaft and wound about the shaft in opposite directions to each other.

14 Claims, 6 Drawing Sheets

FOOT REST LIFTING AND LOWERING DEVICE FOR A WHEELCHAIR

BACKGROUND OF THE INVENTION

1. Field of the Invention

The present invention relates to footrest devices for wheelchairs and more particularly pertains to a new foot rest lifting and lowering device for a wheelchair for lifting the footrest for easy dismounting from the wheelchair.

2. Description of the Prior Art

The use of footrest devices for wheelchairs is known in the prior art. More specifically, footrest devices for wheelchairs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,988,114; U.S. Pat. No. 4,033,624; U.S. Pat. No. 2,793,682; U.S. Pat. No. 5,358,266; U.S. Pat. No. 4,012,074; and U.S. Des. Pat. No. 395,263.

While these devices fulfill their respective, particular objectives and requirements, the aforementioned patents do not disclose a new foot rest lifting and lowering device for a wheelchair. The inventive device includes a footrest coupled to a wheelchair. The footrest includes a bar attached to the wheelchair, a horizontally orientated rod rotatably coupled to a bottom end of the bar, and a plate integrally coupled to the bar and is positionable between a horizontal position and a vertical position. The device includes a shaft rotatably mounted to the wheelchair. A first and second flexible elongated member each has a first end and a second end. The first end of the first elongated member is coupled to a top surface of the plate. The first end of the second elongated member is attached to a bottom surface of the plate. The second ends of the elongated members are attached to the shaft and wound about the shaft in opposite directions to each other. The second elongated member is abutted against an outer surface of the rod. Rotating the shaft in a first direction winds the first elongated member about the shaft and lifts the plate into the vertical position and rotating the shaft in a second direction winds the second elongate member about the shaft and lowers the plate into the horizontal position.

In these respects, the foot rest lifting and lowering device for a wheelchair according to the present invention substantially departs from the conventional concepts and designs of the prior art, and in so doing provides an apparatus primarily developed for the purpose of lifting the footrest for easy dismounting from the wheelchair.

SUMMARY OF THE INVENTION

In view of the foregoing disadvantages inherent in the known types of footrest devices for wheelchairs now present in the prior art, the present invention provides a new foot rest lifting and lowering device for a wheelchair construction wherein the same can be utilized for lifting the footrest for easy dismounting from the wheelchair.

The general purpose of the present invention, which will be described subsequently in greater detail, is to provide a new foot rest lifting and lowering device for a wheelchair apparatus and method which has many of the advantages of the footrest devices for wheelchairs mentioned heretofore and many novel features that result in a new foot rest lifting and lowering device for a wheelchair which is not anticipated, rendered obvious, suggested, or even implied by any of the prior art footrest devices for wheelchairs, either alone or in any combination thereof.

To attain this, the present invention generally comprises a footrest coupled to a wheelchair. The footrest includes a bar attached to the wheelchair, a horizontally orientated rod rotatably coupled to a bottom end of the bar and a plate integrally coupled to the bar and is positionable between a horizontal position and a vertical position. The device includes a shaft rotatably mounted to the wheelchair. A first and second flexible elongated member each has a first end and a second end. The first end of the first elongated member is coupled to a top surface of the plate. The first end of the second elongated member is attached to a bottom surface of the plate. The second ends of the elongated members are attached to the shaft and wound about the shaft in opposite directions to each other. The second elongated member is abutted against an outer surface of the rod. Rotating the shaft in a first direction winds the first elongated member about the shaft and lifts the plate into the vertical position and rotating the shaft in a second direction winds the second elongate member about the shaft and lowers the plate into the horizontal position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot rest lifting and lowering device for a wheelchair apparatus and method which has many of the advantages of the footrest devices for Wheelchairs mentioned heretofore and many novel features that result in a new foot rest lifting and lowering device for a wheelchair which is not anticipated, rendered obvious, suggested, or even implied by any of the prior art footrest devices for wheelchairs, either alone or in any combination thereof.

It is another object of the present invention to provide a new foot rest lifting and lowering device for a wheelchair which may be easily and efficiently manufactured and marketed.

It is a further object of the present invention to provide a new foot rest lifting and lowering device for a wheelchair which is of a durable and reliable construction.

An even further object of the present invention is to provide a new foot rest lifting and lowering device for a wheelchair which is susceptible of a low cost of manufacture with regard to both materials and labor, and which accordingly is then susceptible of low prices of sale to the consuming public, thereby making such foot rest lilting and lowering device for a wheelchair economically available to the buying public.

Still vet another object of the present invention is to provide a new foot rest lifting and lowering device for a wheelchair which provides in the apparatuses and methods of the prior art some of the advantages thereof, while simultaneously overcoming some of the disadvantages normally associated therewith.

Still another object of the present invention is to provide a new foot rest lifting and lowering device for a wheelchair for lifting the footrest for easy dismounting from the wheelchair.

Yet another object of the present invention is to provide a new foot rest lifting and lowering device for a wheelchair which includes a footrest coupled to a wheelchair. The footrest includes a bar attached to the wheelchair, a horizontally orientated rod rotatably coupled to a bottom end of the bar and a plate integrally coupled to the bar and is positionable between a horizontal position and a vertical position. The device includes a shaft rotatably mounted to the wheelchair. A first and second pair of flexible elongated member each has a first end and a second end. The first end of the first elongated member is coupled to a top surface of the plate. The first end of the second elongated member is attached to a bottom surface of the plate. The second ends of the elongated members are attached to the shaft and wound about the shaft in opposite directions to each other. The second elongated member is abutted against an outer surface of the rod. Rotating the shaft in a first direction winds the first elongated member about the shaft and lifts the plate into the vertical position and rotating the shaft in a second direction winds the second elongate member about the shaft and lowers the plate into the horizontal position.

Still yet another object of the present invention is to provide a new foot rest lifting and lowering device for a wheelchair that moves the first rest between a horizontal and a vertical position so that the footrest does not hinder the entering or the leaving of the wheelchair. The device facilitates the moving of the footrest for those who do not the dexterity to bend over and place the footrest in a vertical position.

Even still another object of the present invention is to provide a new foot rest lifting and lowering device for a wheelchair that may be retrofitted to existing wheelchairs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
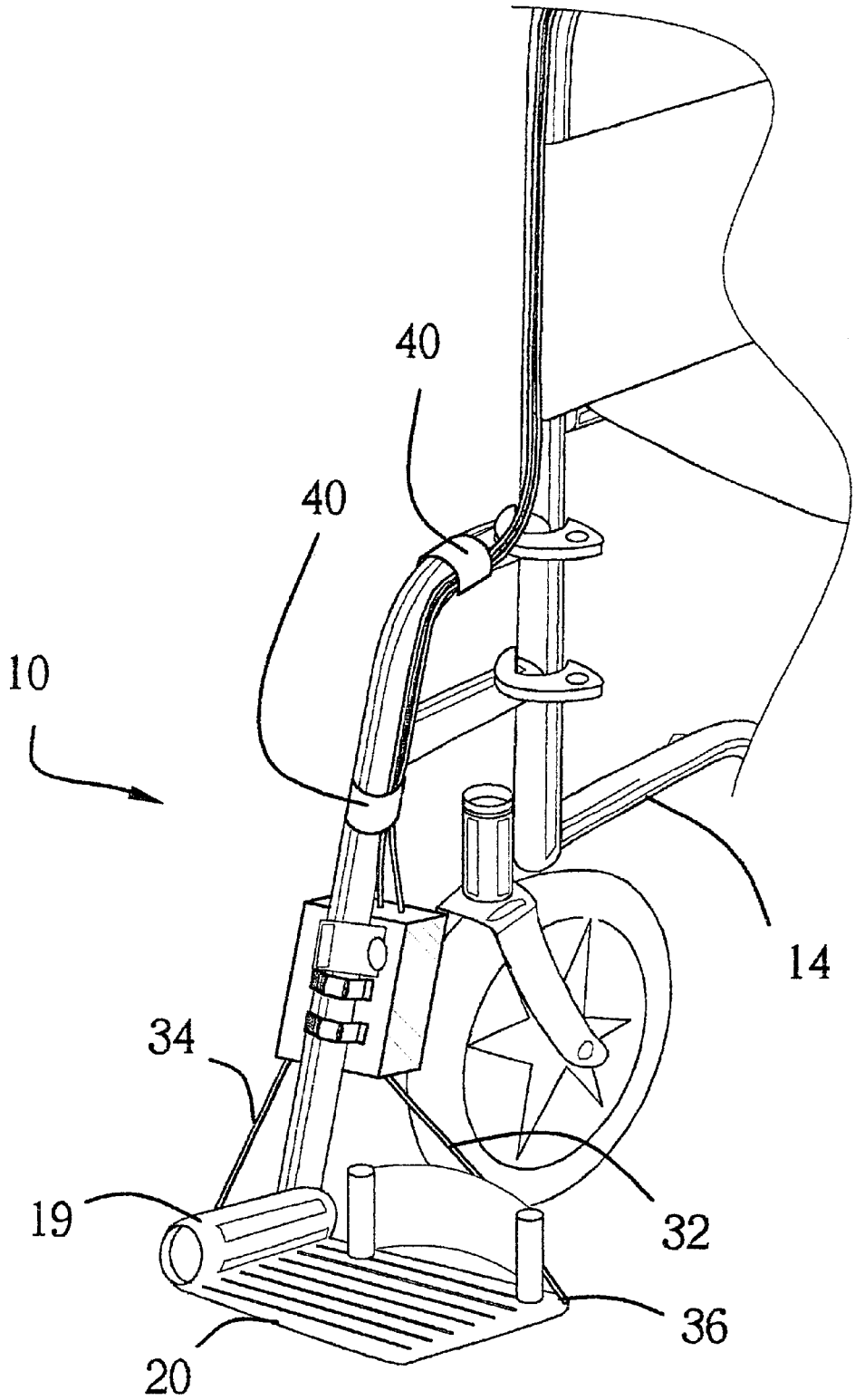
FIG. 1 is a schematic perspective view of a new foot rest lifting and lowering device for a wheelchair according to the present invention.
Figure 2:
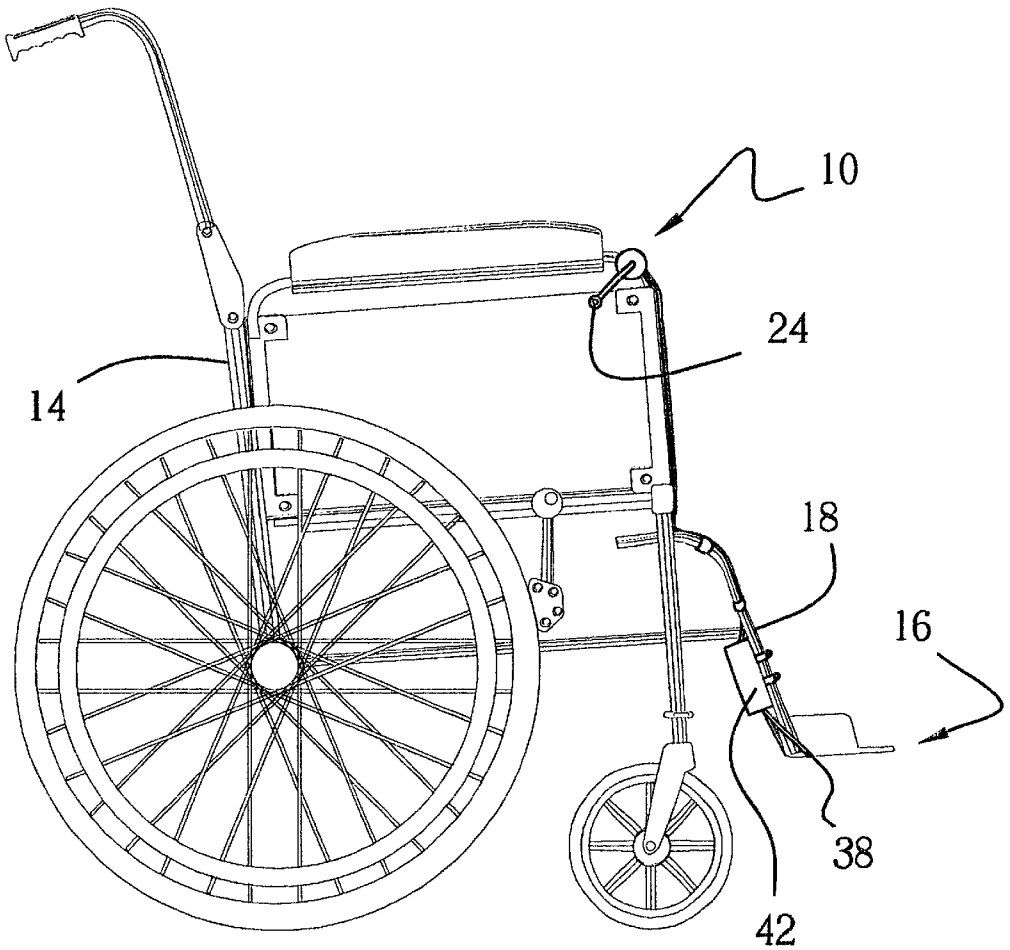
FIG. 2 is a schematic side view of the present invention.
Figure 3:
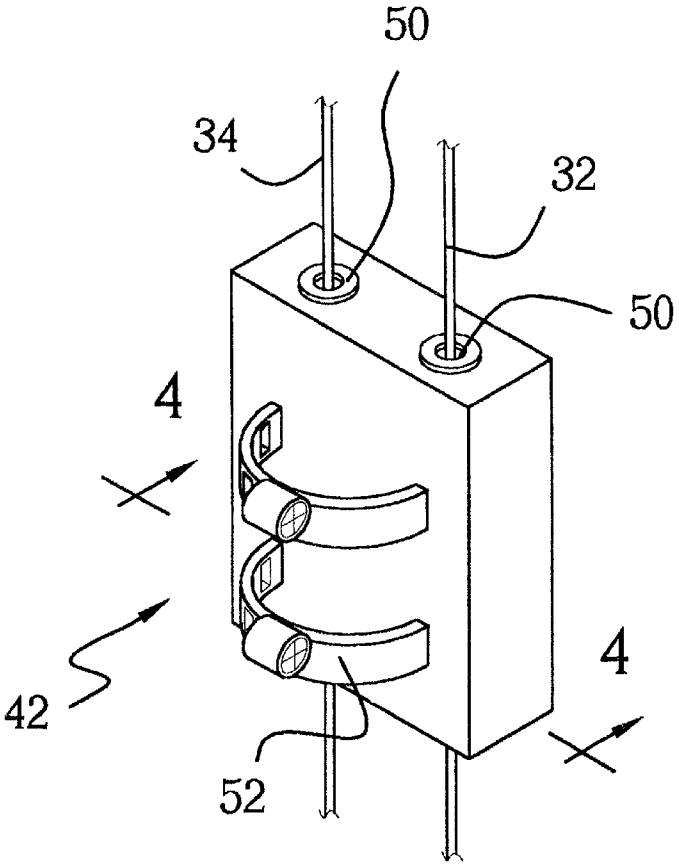
FIG. 3 is a schematic guide member view of the present invention.
Figure 4:
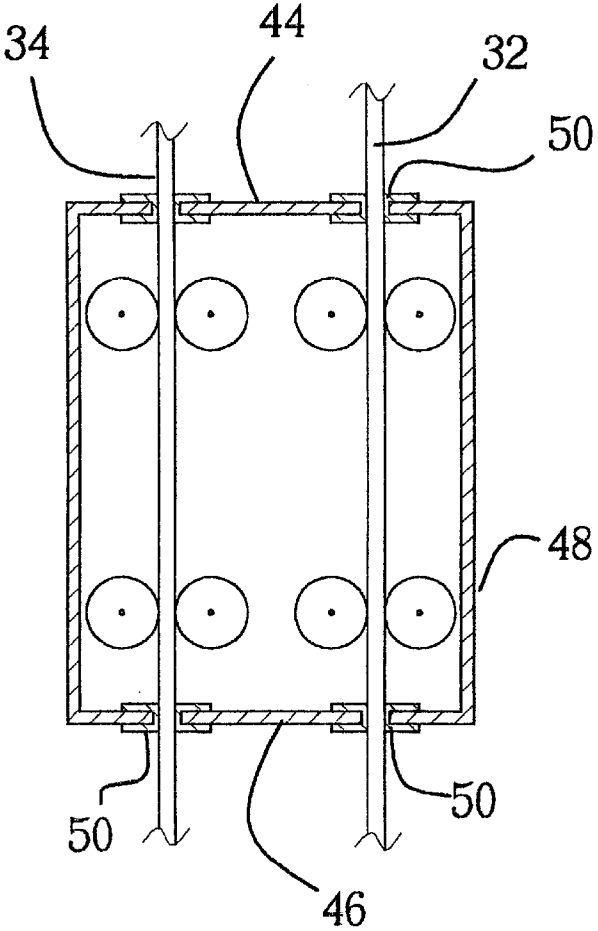
FIG. 4 is a schematic cross-sectional view taken along line 4–4 of FIG. 3 of the present invention.
Figure 5:
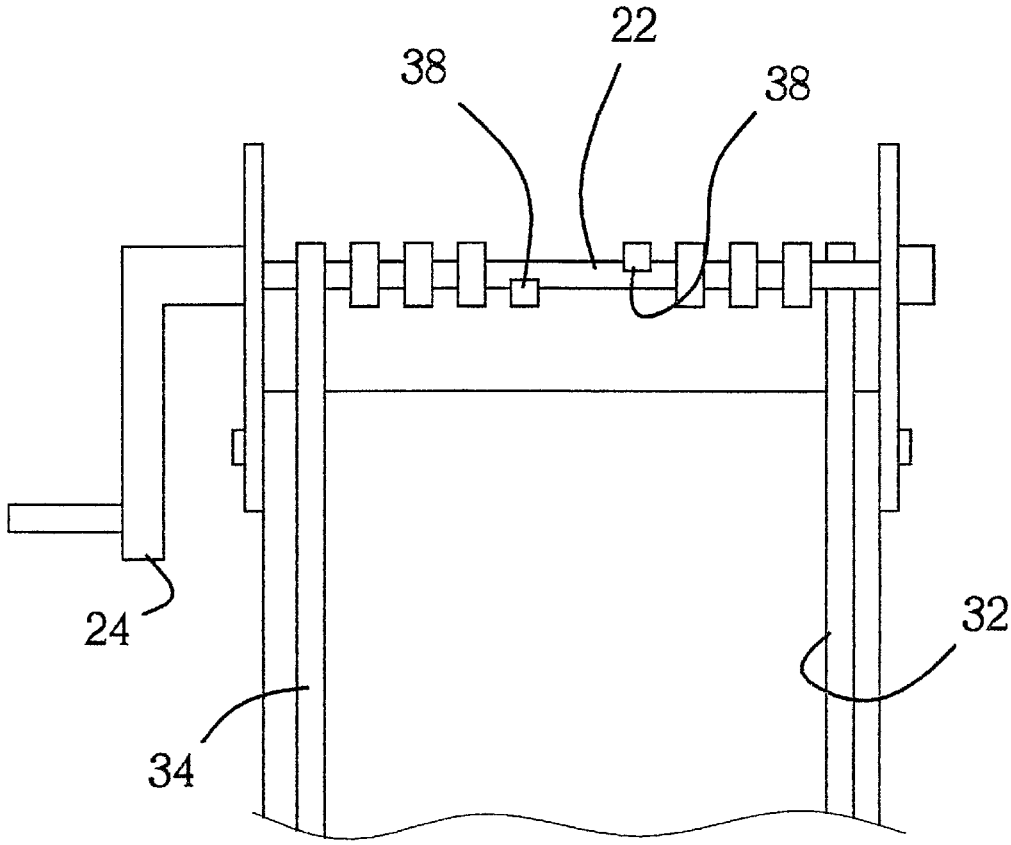
FIG. 5 is a schematic front view of the shaft of the present invention.
Figure 6:
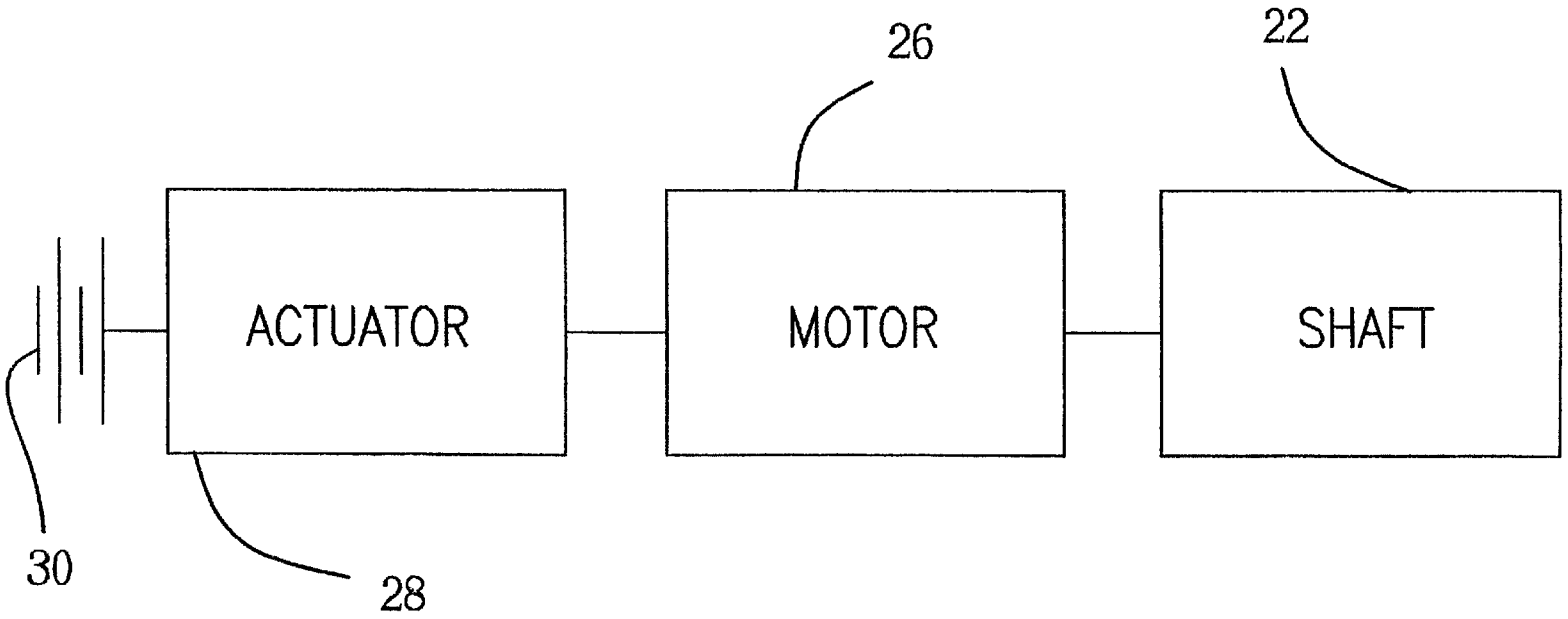
FIG. 6 is an electronic schematic view of the present invention.

With reference now to the drawings, and in particular to FIGS. 1 through 6 thereof, a new foot rest lifting and lowering device for a wheelchair embodying the principles and concepts of the present invention and generally designated by the reference numeral 10 will be described.

As best illustrated in FIGS. 1 through 6, the foot rest lifting and lowering device 10 for a wheelchair 14 generally comprises a device for lifting and lowering a footrest coupled to a wheelchair 14. The footrest 16 includes a bar 18 attached to the wheelchair 14 and extends downwardly from the wheelchair 14. A horizontally orientated rod 19 is rotatably coupled to a bottom end of the bar 18 and extends away from the wheelchair 14. A plate 20 is integrally coupled to the bar 18 and is positionable between a horizontal position extending in front of the wheel chair 14 and a vertical position extending upwardly.

A shaft 22 is rotatably mounted to the wheelchair 14. A handle 24 is attached to an end of the shaft 22 for turning the shaft 22. Alternatively, a motor 26 may be mechanically coupled to the shaft 22. The motor 26 is adapted for rotating the shaft in a first direction and second direction. An actuator 28 is operationally coupled to the motor 26 for selectively rotating the shaft 22 in a first or second direction. A power supply 30, preferably a battery, is operationally coupled to the actuator 28.

Each of a first 32 and second 34 of flexible elongated members has a first end 36 and a second end 38. The first end 36 of the first elongated member 32 is coupled to a top surface of the plate 20 and positioned adjacent to a free edge of the plate opposite of the rod 19. The first end 36 of the first elongated member 32 is positioned adjacent to an edge of the plate proximal to the wheelchair 14. The second end 38 of the first elongated member 32 is attached to the shaft 22 and wound about the shaft 22 in a first direction. The first end 36 of the second elongated member 34 is attached to a bottom surface of the plate 20 and positioned adjacent to the rod 19 and generally between opposite ends of the rod 19. The second end 36 of the second elongated member 34 is attached to the shaft 22 and wound about the shaft 22 in a second direction. The second elongated member 34 is abutted against an outer surface of the rod 19. Each of the elongated members 32, 34 is preferably taught.

A plurality of brackets 40 are positioned on the bar 18. Each of the elongated members 32, 34 extends through the brackets 40 such that the brackets 40 position the elongated members generally adjacent to the bar 18.

A guide member 42 guides the first 32 and second 34 elongate members and prevents their entanglement. The guide member 42 comprises a housing having a top wall 44, a bottom wall 46 and a peripheral wall 48 extending between the top 44 and bottom 46 walls. Each of the top 44 and bottom 46 walls has a pair of apertures 50 extending therethrough such that each of the apertures 50 in the top wall 44 is generally coaxial with one of the apertures in the bottom wall 46. Each of the elongate members 32, 34 extends through one of a pair of coaxial apertures 50. A plurality of fasteners 52 removably attaches the peripheral wall 48 to the bar 18. Fasteners may be loops shown in FIG. 3, brackets, or screws. The housing of the guide member 42 is positioned between the bar 18 and the wheelchair 14.

In use, rotating the shaft 22 in a first direction winds the first elongated member 32 about the shaft 22 and lifts the plate 20 into the vertical position. Rotating the shaft 22 in a second direction winds the second elongate member 34 about the shaft 22 and lowers the plate 20 into the horizontal position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A foot rest lifting and lowering device for lifting and lowering a footrest coupled to a wheelchair, the footrest including a bar attached to the wheelchair and extending downwardly from the wheelchair a horizontally orientated rod being rotatably coupled to a bottom end of the bar and extending away from the wheelchair, a plate being integrally coupled to the bar and being positionable between a horizontal position extending in front of the wheel chair and a vertical position extending upwardly, said device comprising:

a shaft being rotatably mounted to said wheelchair, a handle being attached to an end of said shaft;

a first and second flexible elongated member each having a first end and a second end, said first end of said first elongated member being coupled to a top surface of said plate, said second end of said first elongated member being attached to said shaft and wound about said shaft in a first direction, said first end of said second elongated member being attached to a bottom surface of said plate, said second end of said second elongated member being attached to said shaft and wound about said shaft in a second direction, said second elongated member being abutted against an outer surface of said rod; and wherein rotating said shaft in a first direction winds said first elongated member about said shaft and lifts said plate into said vertical position and rotating said shaft in a second direction winds said second elongate member about said shaft and lowers said plate into said horizontal position.

2. The foot rest lifting and lowering device as in claim 1, wherein said first end of said first elongated member is positioned adjacent to a free edge of said plate opposite of said rod, said first end of said first elongated member being positioned adjacent to an edge of said plate proximal to said wheelchair.

3. The foot rest lifting and lowering device as in claim 1, wherein said first end of said second elongated member is positioned adjacent to said rod and generally between opposite ends of said rod.

4. The foot rest lifting and lowering device as in claim 1, further including a plurality of brackets being positioned on said bar, each of said elongated members extending through said brackets such that said brackets position said elongated members generally adjacent to said bar.

5. The foot rest lifting and lowering device as in claim 1, further including a guide member for guiding said first and second elongate members, said guide member comprising a housing having a top wall, a bottom wall and a peripheral wall extending between said top and bottom walls, each of said top and bottom wall having a pair of apertures extending therethrough such that each of the apertures in said top wall is generally coaxial with one of the apertures in said bottom wall, each of said elongate members extending through one of a pair of coaxial apertures, a plurality of fasteners removably attach said peripheral wall to said bar.

6. The foot rest lifting and lowering device as in claim 1, further including a motor being mechanically coupled to said shaft, said motor being adapted for rotating said shaft in a first direction or a second direction, an actuator for selectively rotating said shaft in first direction or a second direction being operationally coupled to said motor.

7. A foot rest lifting and lowering device for lifting and lowering a footrest coupled to a wheelchair, the footrest including a bar attached to the wheelchair and extending downwardly from the wheelchair, a horizontally orientated rod being rotatably coupled to a bottom end of the bar and extending away from the wheelchair, a plate being integrally coupled to the bar and being positionable between a horizontal position extending in front of the wheel chair and a vertical position extending upwardly, said device comprising:

a shaft being rotatably mounted to said wheelchair, a handle being attached to an end of said shaft;

a first and second of flexible elongated member each having a first end and a second end, said first end of said first elongated member being coupled to a top surface of said plate and positioned adjacent to a free edge of said plate opposite of said rod, said first end of said first elongated member being positioned adjacent to an edge of said plate poximal to said wheelchair, said second end of said first elongated member being attached to said shaft and wound about said shaft in a first direction, said first end of said second elongated member being attached to a bottom surface of said plate and positioned adjacent to said rod and generally between opposite ends of said rod, said second end of said second elongated member being attached to said shaft and wound about said shaft in a second direction, said second elongated member being abutted against an outer surface of said rod;

a plurality of brackets being positioned on said bar, each of said elongated members extending through said brackets such that said brackets position said elongated members generally adjacent to said bar;

a guide member for guiding said first and second elongate members, said guide member comprising a housing having a top wall, a bottom wall and a peripheral wall extending between said top and bottom walls, each of said top and bottom wall having a pair of apertures extending therethrough such that each of the apertures in said top wall is generally coaxial with one of the apertures in said bottom wall, each of said elongate members extending through one of a pair of coaxial apertures, a plurality of fasteners removably attach said peripheral wall to said bar, said housing being positioned between said bar and said wheelchair; and wherein rotating said shaft in a first direction winds said first elongated member about said shaft and lifts said plate into said vertical position and rotating said shaft in a second direction winds said second elongate member about said shaft and lowers said plate into said horizontal position.

8. The foot rest lifting and lowering device as in claim 6, further including a motor being mechanically coupled to said shaft, said motor being adapted for rotating said shaft in a first direction or a second direction, an actuator for selectively rotating said shaft in first direction or a second direction being operationally coupled to said motor.

9. A foot rest lifting and lowering system for lifting and lowering a footrest coupled to a wheelchair, said system comprising:

a footrest including a bar attached to the wheelchair and extending downwardly from the wheelchair, a horizontally orientated rod being rotatably coupled to a bottom end of the bar and extending away from the wheelchair, a plate being integrally coupled to the bar and being positionable between a horizontal position extending in front of the wheel chair and a vertical position extending upwardly;

a shaft being rotatably mounted to said wheelchair, a turning means for rotatably turning the shaft;

first and second flexible elongated member each having a first end and a second end, said first end of said first elongated member being coupled to a top surface of said plate, said second end of said first elongated member being attached to said shaft and wound about said shaft in a first direction said first end of said second elongated member being attached to a bottom surface of said plate, said second end of said second elongated member being attached to said shaft and wound about said shaft in a second direction, said second elongated member being abutted against an outer surface of said rod; and wherein rotating said shaft in a first direction winds said first elongated member about said shaft and lifts said plate into said vertical position and rotating said shaft in a second direction winds said second elongate member about said shaft and lowers said plate into said horizontal position.

10. The foot rest lifting and lowering device as in claim 9, wherein said first end of said first elongated member is positioned adjacent to a free edge of said plate opposite of said rod, said first end of said first elongated member being positioned adjacent to an edge of said plate proximal to said wheelchair.

11. The foot rest lifting and lowering device as in claim 9, wherein said first end of said second elongated member is positioned adjacent to said rod and generally between opposite ends of said rod.

12. The foot rest lifting and lowering device as in claim 9, further including a plurality of brackets being positioned on said bar, each of said elongated members extending through said brackets such that said brackets position said elongated members generally adjacent to said bar.

13. The foot rest lifting and lowering device as in claim 9, further including a guide member for guiding said first and second elongate members, said guide member comprising a housing having a top wall, a bottom wall and a peripheral wall extending between said top and bottom walls, each of said top and bottom wall having a pair of apertures extending therethrough such that each of the apertures in said top wall is generally coaxial with one of the apertures in said bottom wall, each of said elongate members extending through one of a pair of coaxial apertures, a plurality of fasteners removably attach said peripheral wall to said bar.

14. The foot rest lifting and lowering device as in claim 9, wherein said turning means comprises a motor mechanically coupled to said shaft, said motor being adapted for rotating said shaft in a first direction or a second direction, an actuator for selectively rotating said shaft in first direction or a second direction being operationally coupled to said motor.

* * * * *